US008366517B2

(12) United States Patent
Weder

(10) Patent No.: US 8,366,517 B2
(45) Date of Patent: Feb. 5, 2013

(54) FLOOR TREATMENT APPARATUS WITH TENSIONING PULLEY DRIVE

(75) Inventor: James Weder, Sedona, AZ (US)

(73) Assignee: Design Technologies LLC, Bellevue, WA (US)

( * ) Notice: Subject to any disclaimer, the term of this patent is extended or adjusted under 35 U.S.C. 154(b) by 564 days.

(21) Appl. No.: 12/632,191

(22) Filed: Dec. 7, 2009

(65) Prior Publication Data

US 2011/0136418 A1 Jun. 9, 2011

(51) Int. Cl.
*B24B 23/02* (2006.01)

(52) U.S. Cl. ..... 451/353; 15/52; 451/350; 474/87

(58) Field of Classification Search ..... 451/350, 451/351, 352, 353; 474/87; 15/49.1, 52, 15/98

See application file for complete search history.

(56) References Cited

U.S. PATENT DOCUMENTS 7,226,347 B1 * 6/2007 Padgett et al. ..... 451/353
7,326,106 B1 * 2/2008 Rogers et al. ..... 451/350
7,458,883 B2 * 12/2008 Wilson et al. ..... 451/353

* cited by examiner

*Primary Examiner* — Timothy V Eley
(74) *Attorney, Agent, or Firm* — Young & Thompson

(57) ABSTRACT

A floor treatment apparatus includes a frame, a housing which is rotatable with respect to the frame according to a main axis, at least three head pulleys which are rotatable with respect to the housing according to respective head axes which are regularly spaced around, and which are parallel to, the main axis, a motor supported by the frame, a drive pulley which is drivable by the motor, a main belt tensioning pulley and a main belt which is slung around the drive pulley, the head pulleys and the main belt tensioning pulley. Further an auxiliary pulley is coaxially connected to the main belt tensioning pulley. A fixed pulley is connected to the frame. An auxiliary belt is slung around the auxiliary pulley and the fixed pulley for rotating the housing with respect to the frame.

9 Claims, 4 Drawing Sheets

FLOOR TREATMENT APPARATUS WITH TENSIONING PULLEY DRIVE

BACKGROUND OF THE INVENTION

1. Field of the Invention

The invention is related to the field of apparatus for treating floors of stone or stone like material. Such apparatus are well known per se, and are applied for several kinds of treatments. For instance, by means of an apparatus equipped with suitable grinding discs, the process of grinding of floors for the purpose of smoothening new or worn out floors can be carried out. Also, such apparatuses can be used for daily maintenance of heavily used stone floors, such as the floors in public areas, in retail buildings and the like.

The heads of the apparatus may thus be provided with several types of grinding discs or maintenance pads and the like. The heads are usually driven by means of an electric motor which is supported on the frame of the apparatus. At the same time, the housing of the apparatus is slowly driven in rotation as well so as to stabilize the behavior of the apparatus and to simplify handling thereof by the operator. The housing rotation is usually obtained from the same electric motor which drives the heads.

2. Description of the Related Art

Several proposals have been made for enabling the single electric motor to drive both the heads as well as the housing at the required rotational speeds. As mentioned, the housing is rotated at a lower speed than the heads. This entails different drives for the heads on the one hand, and the housing on the other hand. Examples of such apparatuses are given in U.S. Pat. No. 6,783,447, U.S. Pat. No. 7,241,210, EP-A-1.915.232, WO-A-94/08752 and WO-A-02/062524.

BRIEF SUMMARY OF THE INVENTION

The object of the invention is to provide an apparatus of the type before which has a simple and reliable construction. Said object is achieved by means of a floor treatment apparatus, comprising a frame, a housing which is rotatable with respect to the frame according to a main axis, at least three head pulleys which are rotatable with respect to the housing according to respective head axes which are regularly spaced around, and which are parallel to, the main axis, a motor supported by the frame, a drive pulley which is drivable by the motor, a main belt tensioning pulley, a main belt which is slung around the drive pulley, the head pulleys and the main belt tensioning pulley, an auxiliary pulley coaxially connected to the main belt tensioning pulley, a fixed pulley connected to the frame and an auxiliary belt slung around the auxiliary pulley and the fixed pulley for rotating the housing with respect to the frame.

In the floor treatment apparatus according to the invention, the drive motor, preferably an electric drive motor, first of all drives the main belt through the drive pulley. This main belt in turn drives the head pulleys and the heads. Onto the heads, polishing pads and the like are connected and which are rotated as well for exerting the desired treatment on the floor. For the purpose of preventing slip between the main belt and the pulleys, said main belt is tensioned by means of a main belt tensioning pulley, as is usually the case in belt driven floor treatment apparatuses.

Said tensioning pulley is however not only used for a tensioning the main belt, but is also used for supplying rotating power to the housing for the purpose of rotating said housing. This is achieved in that said tensioning pulley is coaxially connected to a shaft onto which is also connected an auxiliary pulley in such a way that a torque transfer is obtained between sad tensioning pulley and said auxiliary pulley. The auxiliary pulley in turn cooperates with a fixed pulley, which is non-rotatably fixed to the frame, through an auxiliary belt which is slung around said auxiliary pulley and fixed pulley.

As a result, with a relatively low number of components, both the rotational movement of the pulley heads as well as of the housing is obtained. Moreover, the head pulleys themselves are only exposed to the torque which is necessary for driving the polishing pads, grinding pads etc which are connected thereto, but not to the torque which is necessary for rotating the housing. The latter torque for rotating the housing is taken care of by the tensioning pulley. Said tensioning pulley thus plays the dual role of both tensioning the main pulley and of feeding torque to the housing for the rotation thereof.

Usually, it is desirable to make the polishing pads etc rotate in one and the same direction while carrying out the floor treatment operation. This can be ascertained by having the main belt slung around the drive pulley and the head pulleys in such a way that said pulleys are in contact with one and the same side of said main belt and said pulleys are drivable in the same rotational sense. Also, it is generally desirable to make the housing rotate in the direction opposite to the rotational direction of the polishing pads. To that end, the main belt tensioning pulley is on the side of the main belt which is opposite the side where the head pulleys are located, and the auxiliary belt is slung around the auxiliary pulley and the fixed pulley in such a way that they are on opposite sides of the auxiliary belt.

Furthermore, the auxiliary belt can be slung around two idle pulleys which are on the same side of the auxiliary belt as the fixed pulley. For the purposes of obtaining the desired cooperation between the auxiliary belt, the auxiliary pulley and the fixed pulley, at least one of the idle pulleys can be an auxiliary belt tensioning pulley.

The adjustment means of the auxiliary belt can be carried out in several ways; for instance, said adjustment means may comprise a rack and pinion device. However, other tensioning means such as screw drive adjustment means are possible as well. Furthermore, the position of the main belt tensioning pulley may be adjusted for instance by a sleeve construction or an eccenter mechanism. Also, multiple suspension positions for the main belt tensioning pulley may be provided.

DETAILED DESCRIPTION OF THE PREFERRED EMBODIMENTS

According to a preferred embodiment, the housing comprises a base plate. The drive pulley, the head pulleys, the main belt tensioning pulley and the main belt are on one and the same side, preferably the topside, of said base plate. Furthermore, the housing may comprise a top plate, whereby the fixed pulley, the auxiliary pulley and the auxiliary belt may be accommodated on top of the top plate.

BRIEF DESCRIPTION OF THE DRAWINGS

The intervention will now be described further with reference to the embodiment shown in the figures.

Figure 1:
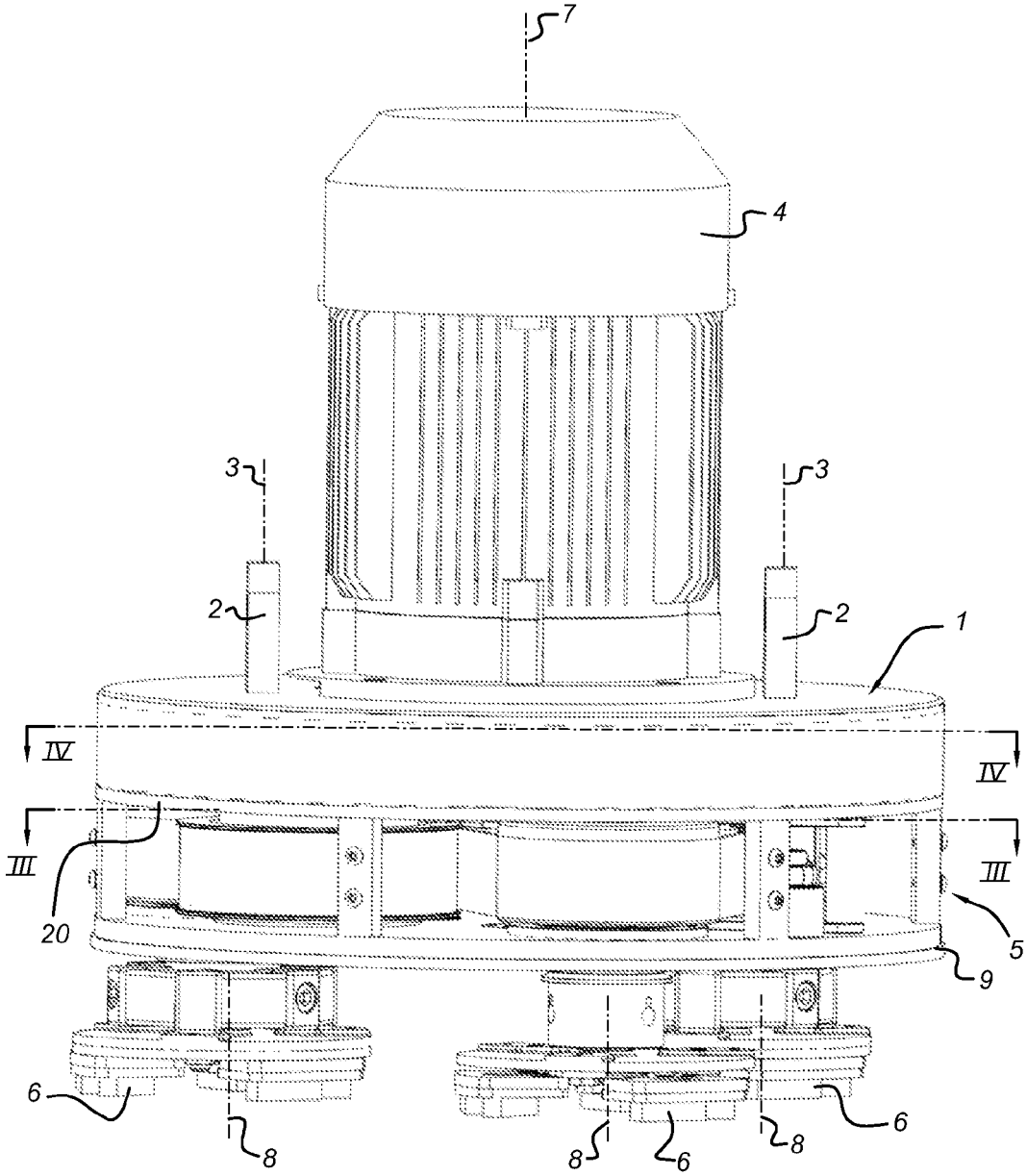
FIG. 1 shows a partly open side view of the floor treatment apparatus.
Figure 2:
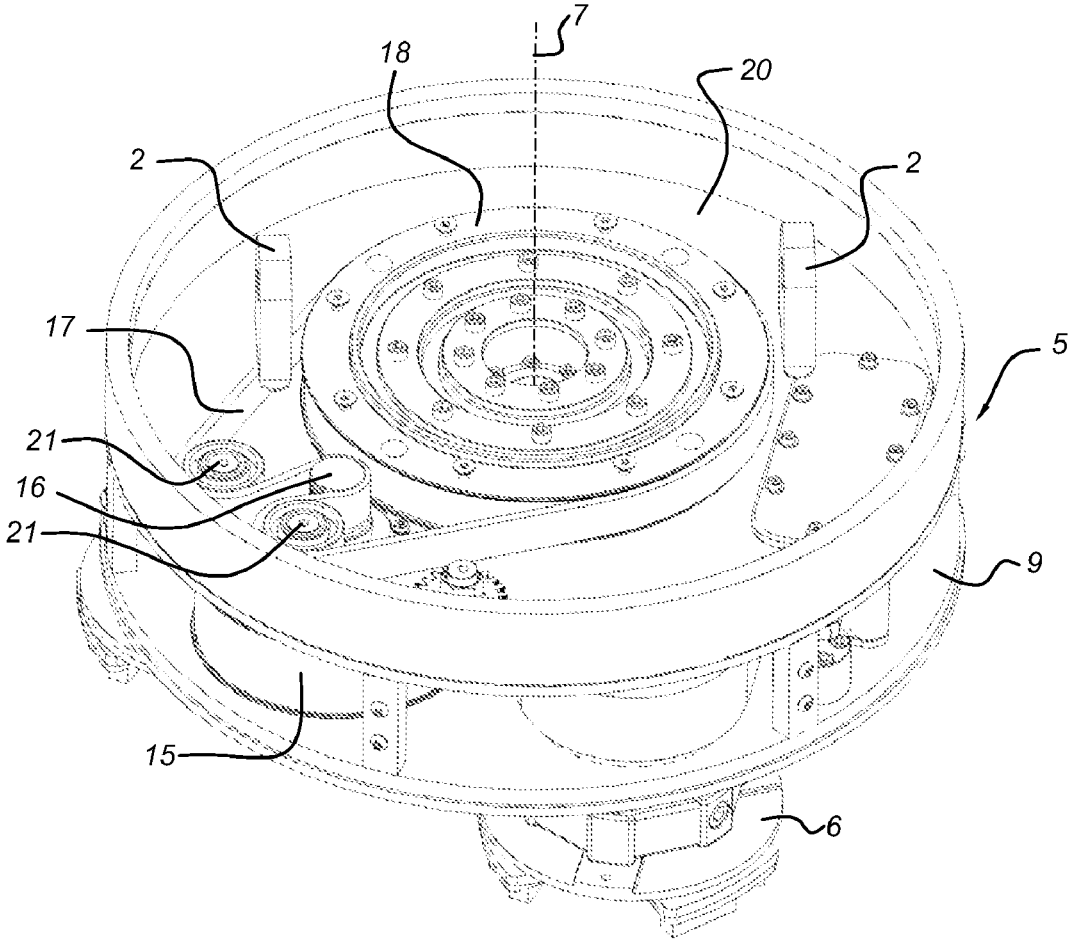
FIG. 2 shows a partly open top view in perspective.

The floor treatment machine as shown in the side view of FIG. 1 comprises a frame 1 having lugs 2 onto which the handlebars 3 are mounted. By means of these handlebars 3, the operator can direct the floor treating machine in any desired direction over a floor surface to be treated. An electric motor 4 is supported on the frame 1. Furthermore, a housing 5 is connected to the frame 1 in such a way that it is rotatable about a central axis 7 which coincides with the axis of the electric motor 4. For reasons of clarity, part of the side wall of the housing 5 has been left away. Three heads 6 are in turn rotatably supported with respect to the housing 5; their axes of rotation 8 are regularly arranged around the central axis 7 and are parallel to said central axis.

The housing 5 has a base plate 9 and a top plate 20 through which base plate 9 three shafts 10 extend. Said shafts 10 are regularly spaced around the central axis 7. Each shaft 10 is rotatably supported with respect to the base plate 9 by means of suitable bearings (not visible). Onto each shaft 10, above the base plate 9, a head pulley 11 is connected. Furthermore, a respective head 6 is connected onto each shaft 10, in such a way that a torque can be transferred between each head pulley 11 and a respective head 6. These heads, which are shown in FIG. 1, are positioned beneath the base plate 9. Around the head pulleys 11, a main belt 13 is slung. Furthermore, said main belt 13 is slung around the drive pulley 14 which is connected to the drive shaft of the electric motor 4.

The main belt 13 is also slung around the tensioning pulley 15, in such a way that sad tensioning pulley 15 is on the side of the belt opposite the side where the head pulleys 11 are located. The tensioning pulley 15 in turn is driven in a direction opposite to the direction of the head pulleys 11. Said tensioning pulley 15 is connected to an auxiliary pulley 16 in such a way that a torque can be transmitted between these pulleys 15, 16. An auxiliary belt 17 is slung around the auxiliary pulley 16 as well as around the fixed pulley 18 which is connected to the frame 1. The auxiliary pulley 16, auxiliary belt 17 and fixed pulley 18 are all positioned above the top plate 20 of the housing 5. Idle pulleys 21 have been provided for a proper routing of the auxiliary belt 17 around the auxiliary pulley 16.

The tensioning pulley 15 may be positioned with respect to the main belt 13 in such a way that the proper tension In the main belt 13 can be maintained.

For the purpose of improving the traction between the main belt 13, the head pulleys 11 and the drive pulley 14, the contacting surfaces thereof may be provided with grooves which are oriented in the running direction. Similarly, the auxiliary belt 17, the auxiliary pulleys 16 and the fixed pulley 18 may have contacting surfaces provided with such grooves. By means of tensioning mechanism 19, the position of one of the idle pulleys 21 and thus the tension in the auxiliary belt 17 may be adjusted.

Figure 3:
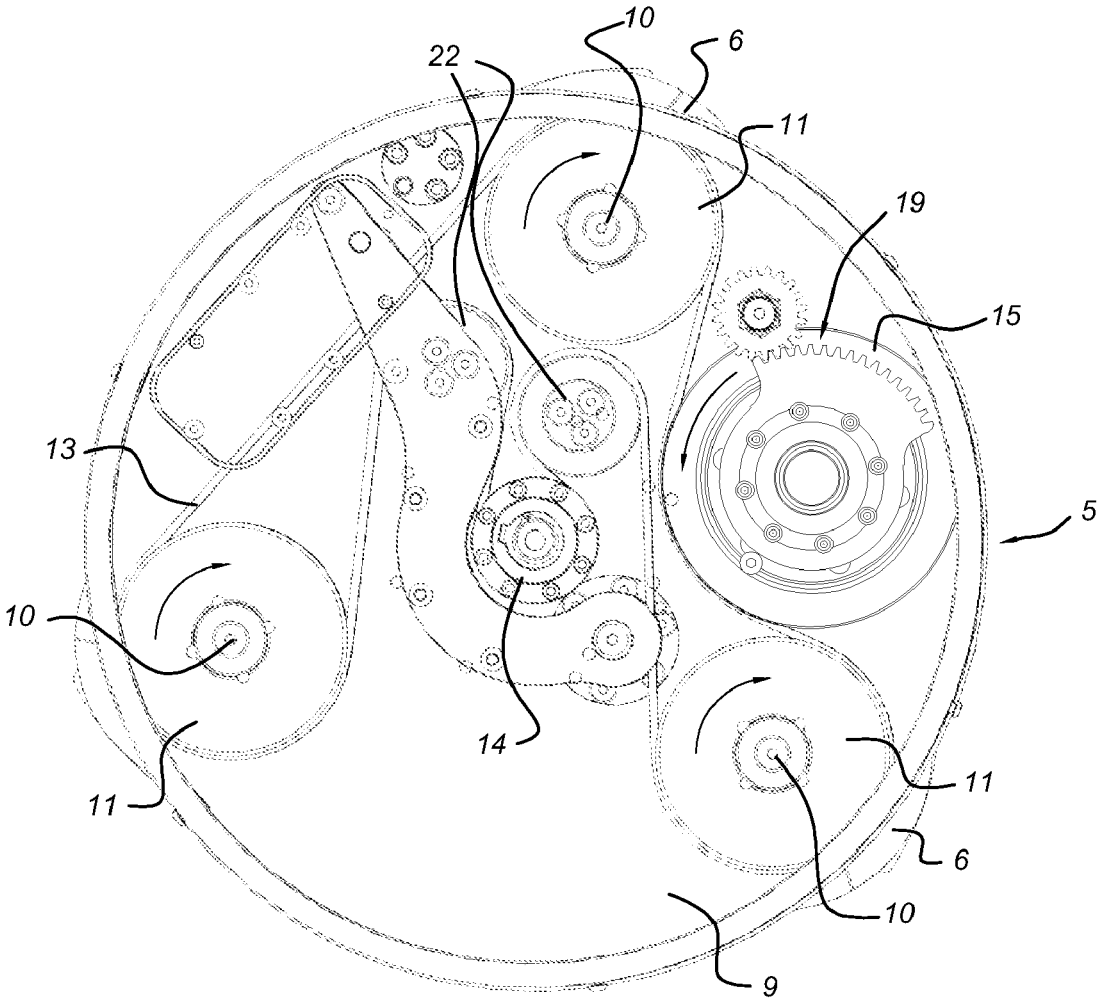
FIG. 3 shows a view according to III-III of FIG. 2.
Figure 4:
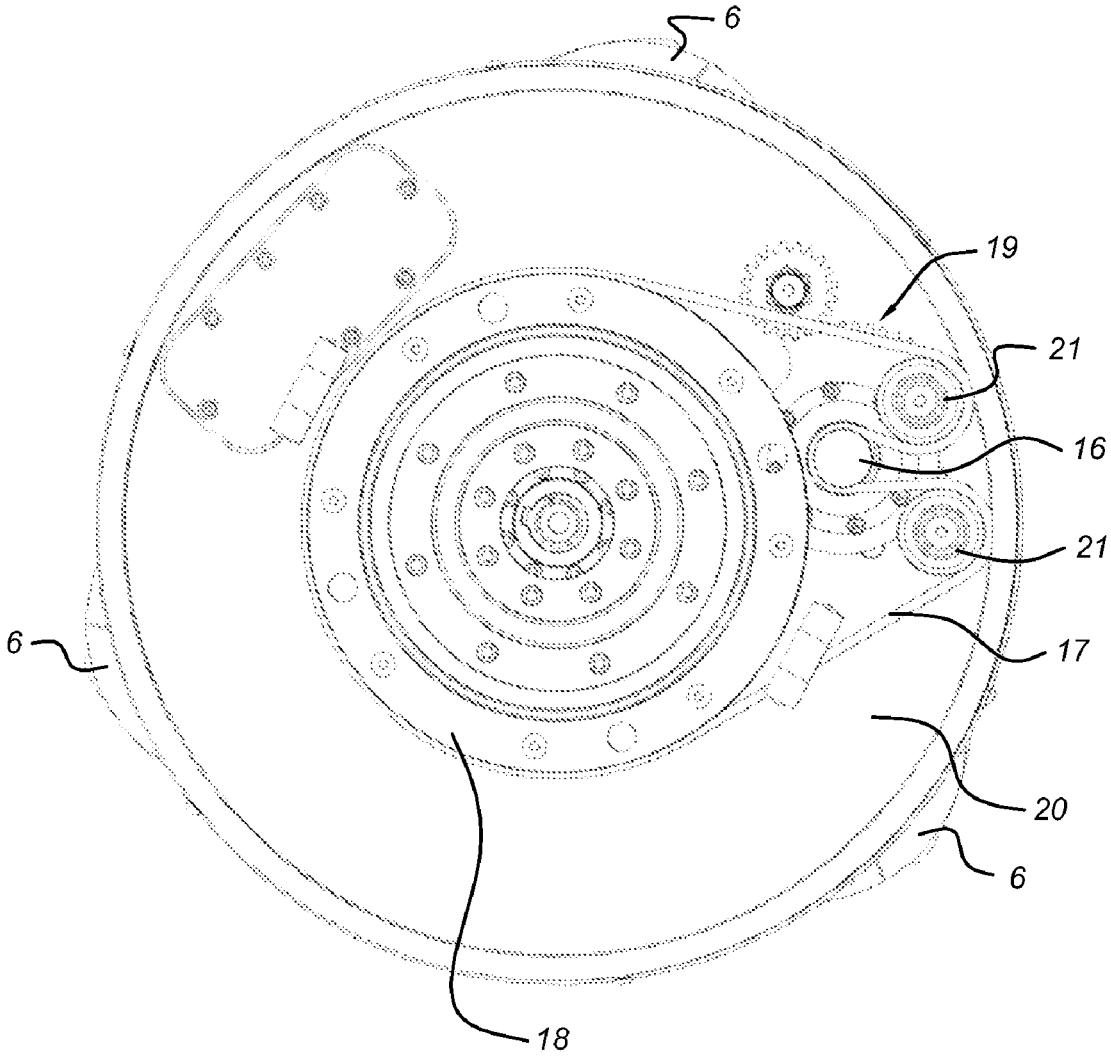
FIG. 4 shows a view according to IV-IV of FIG. 2.

As shown in the view of FIG. 3, the main belt 13 has also been slung around the auxiliary pulleys 22 so as to increase the contact length, in running direction, between the main belt 13 and the drive pulley 14. Due to the fact that these idle pulleys 22 are located on the side of the main belt 13 opposite to the side where they head pulleys 11 and the drive pulley 14 are located, said idle pulleys 22 may have a smooth surface.

LIST OF REFERENCE NUMERALS

1. Frame
2. Lug
3. Handlebar
4. Electric motor
5. Housing
6. Head
7. Central axis
8. Head axis
9. Base plate
10. Shaft
11. Head pulley
13. Main belt
14. Drive pulley
15. Tensioning pulley
16. Auxiliary pulley
17. Auxiliary belt
18. Fixed pulley
19. Adjustment mechanism
20. Top plate housing
21. Idle pulley
22. Idle pulley

The invention claimed is:

1. A floor treatment apparatus, comprising:
a frame;
a housing which is rotatable with respect to the frame about a main axis;
at least three head pulleys which are rotatable with respect to the housing about respective head axes which are regularly spaced around, and which are parallel to, the main axis;
a motor supported by the frame;
a drive pulley which is drivable by the motor;
a main belt tensioning pulley;
a main belt extending around the drive pulley, the head pulleys and the main belt tensioning pulley;
an auxiliary pulley coaxially connected to the main belt tensioning pulley;
a fixed pulley connected to the frame; and
an auxiliary belt extending around the auxiliary pulley and the fixed pulley for rotating the housing with respect to the frame.

2. The floor treatment apparatus according to claim 1, wherein the main belt extends around the drive pulley and the head pulleys in such a way that said head pulleys are in contact with one and the same side of said main belt and said head pulleys are drivable in the same rotational sense, and wherein the main belt tensioning pulley (15) is on an opposite side with respect to the one side of said main belt and is drivable in the rotational direction opposite to the rotational direction of the head pulleys.

3. The floor treatment apparatus according to claim 1, wherein the auxiliary belt extends around the auxiliary pulley and the fixed pulley in such a way that the auxiliary pulley and the fixed pulley are on opposite sides of the auxiliary belt.

4. The floor treatment apparatus according to claim 3, wherein the auxiliary belt extends around two idle pulleys which are on the same side of the auxiliary belt as the fixed pulley.

5. The floor treatment apparatus according to claim 4, wherein at least one of the idle pulleys is an auxiliary belt tensioning pulley, the position of the auxiliary belt tensioning pulley being adjustable by means of an adjustment mechanism.

6. The floor treatment apparatus according to claim 5, wherein the adjustment means of the auxiliary belt comprises a rack and pinion device.

7. The floor treatment apparatus according to claim 1, wherein the housing comprises a base plate, and wherein the drive pulley, the head pulleys, the main belt tensioning pulley and the main belt are on one and the same side of said base plate.

8. The floor treatment apparatus according to claim 7, wherein the fixed pulley, the auxiliary pulley and the auxiliary belt are above the top plate of the housing.

9. The floor treatment apparatus according to claim 1, wherein the head pulleys are each provided with a head onto which one or more of polishing means and grinding means can be connected.

* * * * *